US006862988B2

(12) United States Patent
Dylla et al.

(10) Patent No.: US 6,862,988 B2
(45) Date of Patent: Mar. 8, 2005

(54) INKING UNIT FOR ROTARY PRINTING MACHINE

(75) Inventors: Norbert Dylla, Stadtbergen (DE); Günter Koppelkamm, Neuensalz (DE); Ulrich Geiger, Aichen (DE); Bernd Hennig, Plauen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/294,389

(22) Filed: Nov. 14, 2002

(65) Prior Publication Data

US 2003/0094110 A1 May 22, 2003

(30) Foreign Application Priority Data

Nov. 20, 2001 (DE) ..... 201 18 941

(51) Int. Cl.[7] ..... B41F 31/06
(52) U.S. Cl. ..... 101/351.3; 101/209
(58) Field of Search ..... 101/210, 208, 101/207, 209, 364, 363, 352.01, 350.1, 352.04, 351.1, 351.3

(56) References Cited

U.S. PATENT DOCUMENTS

| | | | | |
|---|---|---|---|---|
| 4,481,883 A | 11/1984 | Savart et al. | ..... | 101/363 |
| 5,848,570 A | 12/1998 | Koppelmann et al. | ... | 101/350.1 |

FOREIGN PATENT DOCUMENTS

| | | | |
|---|---|---|---|
| DE | 1 290 154 | 3/1969 | |
| DE | 196 29 810 | 1/1998 | ..... B41F/31/04 |
| DE | 196 29 811 | 1/1998 | ..... B41F/31/10 |

*Primary Examiner*—Andrew H. Hirshfeld
*Assistant Examiner*—Leo T. Hinze
(74) *Attorney, Agent, or Firm*—Cohen, Pontani, Lieberman & Pavane

(57) ABSTRACT

An inking unit for a rotary printing machine includes an ink fountain, a pivotable ink fountain holder in which the ink fountain is mounted, an ink ductor, and a pivotable ink ductor holder in which the ink ductor is mounted. The ink ductor holder and the ink fountain holder are connected by an operating cylinder so that ductor and the ink fountain can be pivoted jointly to a first position in which ink flows out of the ductor without flowing out of the fountain, and so that the ductor can be pivoted away from the first position to a second position while the ink fountain remains in the first position, thereby creating a gap between the ductor and the ink fountain.

10 Claims, 2 Drawing Sheets

INKING UNIT FOR ROTARY PRINTING MACHINE

BACKGROUND OF THE INVENTION

1. Field of the Invention

The invention relates to an inking unit for a rotary printing machine, having a ductor which is pivotably mounted by means of a ductor holder, and an ink fountain which is pivotably mounted by means of an ink fountain holder, the ductor and the ink fountain being jointly pivotable to a first position in which the ink is moved away from the ductor without running out of the ink fountain.

2. Description of the Related Art

U.S. Pat. No. 5,848,570 discloses an inking unit in which an ink ductor, together with an ink fountain, can be pivoted away from an operating position on a film roll. The ductor and also the ink fountain are each mounted in holders and can be pivoted with the latter. Ductor and ink fountain are first brought into a first pivoted position, in which the ink fountain can be emptied or an ink fountain insert can be removed. The ink fountain can then be brought on its own into a further pivoted position, the ink knife being removed away from the ductor and it then being possible for these parts to be cleaned.

In the case of this ink fountain, it is disadvantageous that subareas, for example divided off by means of inserted dividing cheeks, in which no ink change is to be carried out, also have to be emptied since the ink would overflow in them when in the cleaning position. Otherwise, the ink fountain would have to be divided up into individual separately pivotable ink fountains, with the disadvantage of high expenditure on construction for the fountains and complicated individual control systems for their pivoting operation.

SUMMARY OF THE INVENTION

It is an object of the invention to provide an inking unit with which an ink change is possible in subareas without having to empty the ink fountain entirely.

According to the invention, in the case of an inking unit of the generic type, the ductor can be pivoted into a second position while the ink fountain remains in the first position, thus providing a gap between the ductor and the ink fountain. By virtue of the ability of the ductor to be moved away from the ink fountain, which is pivoted away but not running empty, the possibility of changing its ink and cleaning it in subareas is provided without having to empty other subareas. It is therefore not necessary to design subareas of the ink fountain such that they can be pivoted separately, which is costly.

The invention is to be explained in more detail below using an exemplary embodiment.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
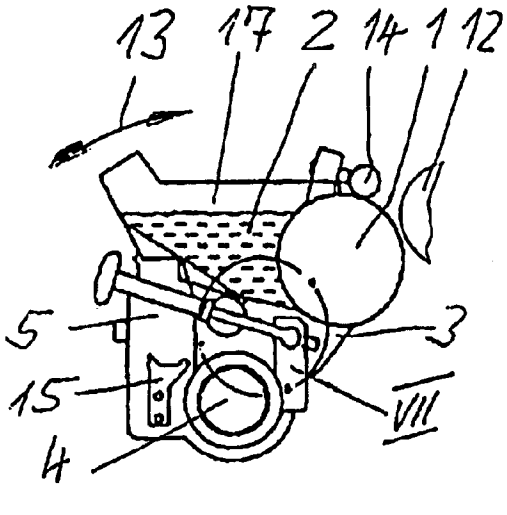

FIG. 1 shows a ductor 1 and an ink fountain 2 of an inking unit of a rotary printing machine. The ductor 1 is mounted in a ductor holder 3 and by means of the latter can be pivoted about a shaft 4. The ink fountain 2 is mounted on an ink fountain holder 5 and by means of the latter can be pivoted about the same shaft 4. The shaft 4 can also be connected permanently to the ductor holder 3 or to the ink fountain holder 5 and serve as a cross member for one of these holders 3, 5.

Figure 3:
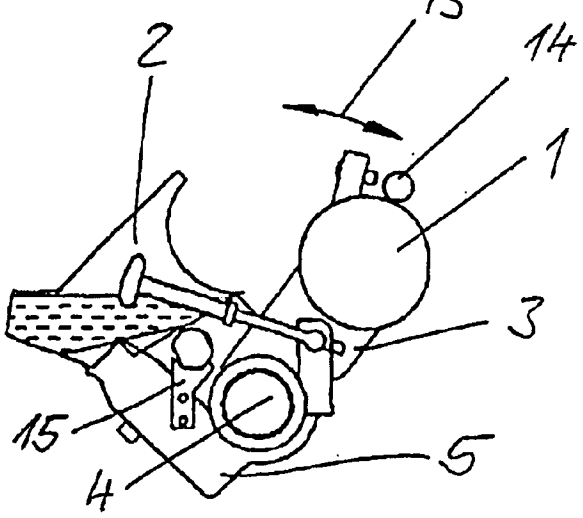
FIGS. 1 to 6 show a ductor and an ink fountain of an inking unit in various pivoted positions.
Figure 4:
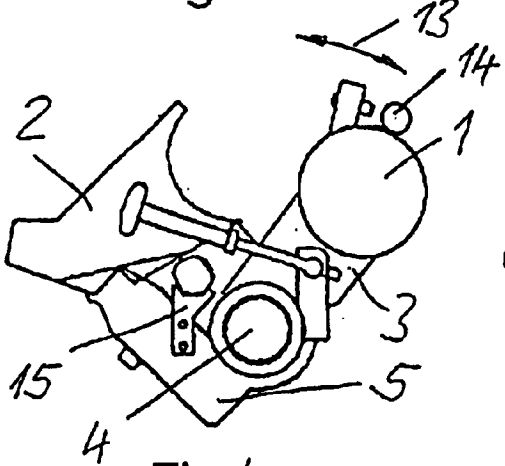
Figure 7:
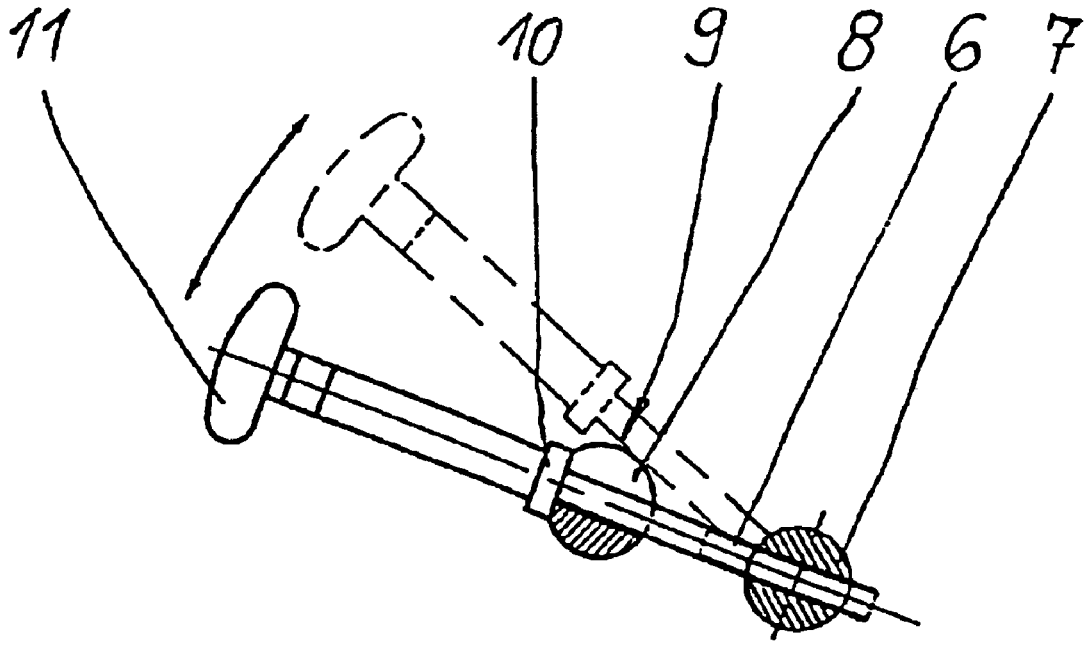
FIG. 7 shows the detail VII from FIG. 1.

The ductor holder 3 and the ink fountain holder 5 are coupled by means of a coupling rod 6, so that they can be pivoted jointly about the shaft 4 (FIG. 7). The coupling rod 6 is firstly screwed into a spindle nut 7 rotatably mounted in the ductor holder 3 and secondly inserted into the slot 8 in a slotted bearing 9 fixed to the ink fountain holder 5. The ink fountain holder 5 rests with the slotted bearing 9 on an upset 10 of the coupling rod 6, under the action of gravity. As a result of rotation at the handle 11, the coupling rod 6 can be screwed into the spindle nut 7 or out of the latter. In addition, the above-described connection between the ductor holder 3 and the ink fountain holder 5 can be released, by the coupling rod 6 being pivoted out of the slot 8 in the slotted bearing 9 (FIGS. 3 and 4.

According to FIG. 1, the ductor 1, together with the ink fountain 2, is in an operating position, that is to say it is set against a film roll 12 (indicted by thin lines in FIG. 1), leaving a small gap. For this purpose, a drive 13 acts on the ductor holder 3 and moves the ductor holder 3 against a stop fixed to the frame, for example a cross member 14. In the process, the ink fountain 2 is carried along by means of the coupling rod 6. The drive 13 can be designed as an operating cylinder, for example, which is supported on the ductor holder 3 and on the frame, as shown in U.S. Pat. No. 5,848,570 mentioned at the beginning. Designs for the ductor holder 3 and for the ink fountain holder 5 are also shown there. The holders 3 and 5 can also be pivoted by hand.

Figure 6:
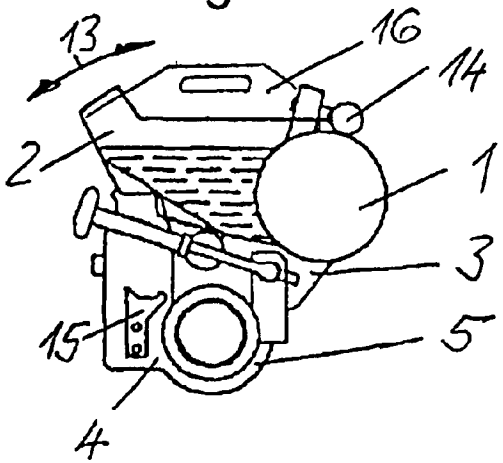
Figure 2:
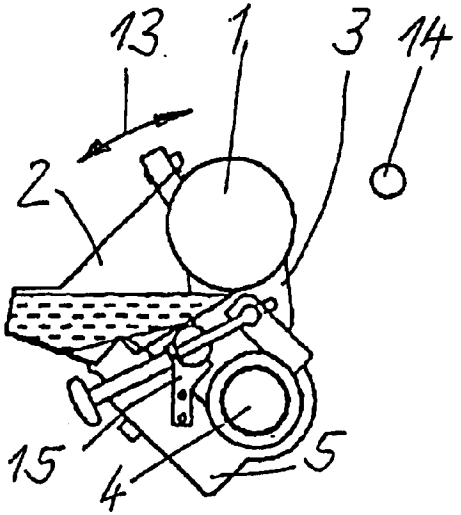
Figure 5:
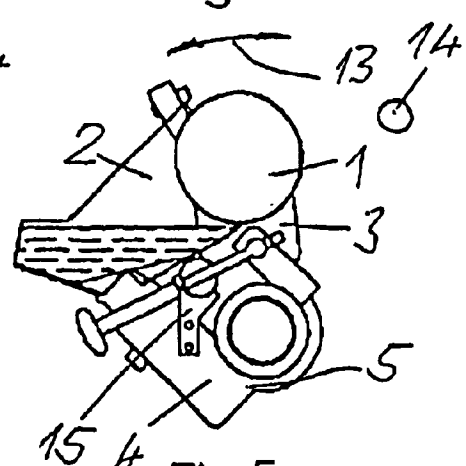

For an ink change in the ink fountain 2, the latter together with the ductor 1 is pivoted by means of the drive 13 in a first direction into a first position, shown in FIG. 2. The pivoting movement is limited by the stop 15 fixed to the frame, against which the ink fountain holder 5 strikes with the slotted bearing 9. In this first position, the ink flows away from the ductor 1 without running out in the process at the end of the ink fountain 2 pivoted downwards. The coupling connection between ductor holder 3 and ink fountain holder 5 is then released by the coupling rods 6 being pivoted out of the slot 8 in the slotted bearing 9 (FIG. 3), and then the ductor 1 together with ductor holder 3 is pivoted by means of the drive 13 in a second, opposite direction into a second position, shown in FIG. 3. The ink can then be removed from the ink fountain 2 (FIG. 4) and the washing of ink fountain 2 together with ink knife and ductor 1 can be performed, by virtue of the gap created between these parts. The new printing ink (ink change) is then put into the ink fountain 2, by means of the drive 13 the ductor 1 is pivoted back in the first direction against the ink fountain 2 and the latter is coupled to the ductor holder 3 by inserting the coupling rod 6 into the slot 8 in the slotted bearing 9 (FIG. 5) Finally, the ink fountain 2 and the ductor 1 are jointly pivoted in the second direction into the operating position by means of the drive 13 (FIG. 6).

An ink change in the manner described is also possible if ink fountain inserts are used in the ink fountain 2. An ink fountain insert 16 of this type is also shown by thin lines in FIG. 6. In the first position of the ink fountain 2, ink fountain inserts of this type do not overflow either and can be changed.

The ink fountain 2, for example extending over the entire width of the inking unit, can also be subdivided into subareas, for example of one page width, by means of inserted dividing cheeks. It is then possible, with the ink fountain 2 pivoted into the first position, to change the ink in a subarea while in the other areas the ink can be left in the ink fountain 2. A dividing cheek 17 of this type is drawn with thin lines in FIG. 1 (contour coincides with that of the ink fountain 2).

The ductor holder 3 and the ink fountain holder 5 can, for example, also have a drive connection via an operating cylinder. In the retracted state, the operating cylinder ensures contact between the ink fountain 2 and the ductor 1. Pivoting the ductor 1 into the second position is made possible after the operating cylinder has been depressurized.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An inking unit for a rotary printing machine, said inking unit comprising:

an ink fountain, a pivotable ink fountain holder in which said ink fountain is mounted, an ink ductor, a pivotable ink ductor holder in which said ink ductor is mounted so that said ink ductor and said ink fountain can be pivoted jointly in a first direction to a first position in which ink flows away from said ductor without flowing out of the fountain, and so that said ductor can be pivoted from said first position in a second direction to a second position while said ink fountain remains in said first position, wherein said second direction is opposite to said first direction, thereby creating a gap between said ductor and said ink fountain, and a fixed stop, said pivotable ink fountain holder comprising a bearing which strikes against said fixed stop when said ink fountain is in said first position, thereby limiting said ink fountain holder against further pivoting in said first direction.

2. An inking unit as in claim 1 further comprising a drive for pivoting said ductor holder.

3. An inking unit as in claim 1 wherein said ink fountain holder is coupled detachably to said ductor holder.

4. An inking unit as in claim 1 further comprising an operating cylinder which connects said ink fountain holder and said ductor holder so that said ink fountain holder and said ductor holder can be pivoted jointly.

5. An inking unit as in claim 1 further comprising an ink fountain insert which can be inserted into said ink fountain.

6. An inking unit as in claim 1 wherein said ink fountain extends over the entire width of said inking unit, said inking unit further comprising dividing cheeks which can be inserted into said ink fountain to divide said ink fountain into subareas.

7. An inking unit as in claim 1 further comprising fixing means for detachably fixing said ink fountain holder against rotation with respect to said ink ductor holder.

8. An inking unit as in claim 7 wherein said fixing means comprises a coupling rod which is pivotably mounted to one of said holders and a slot which is fixed in the other of said holders, said rod being received in said slot to fix said ink fountain holder against rotation with respect to said ink ductor holder.

9. An inking unit as in claim 8 wherein said coupling rod is pivotably mounted to said ink ductor holder.

10. An inking unit as in claim 9 wherein said slot is provided in said bearing.

* * * * *